US009920663B2

(12) United States Patent
Tsuneishi et al.

(10) Patent No.: US 9,920,663 B2
(45) Date of Patent: Mar. 20, 2018

(54) HOLLOW POPPET VALVE

(71) Applicant: NITTAN VALVE CO., LTD., Hadano-shi, Kanagawa (JP)

(72) Inventors: Osamu Tsuneishi, Kanagawa (JP); Atsuyuki Ichimiya, Kanagawa (JP)

(73) Assignee: NITTAN VALVE CO., LTD., Kanagawa (JP)

( * ) Notice: Subject to any disclaimer, the term of this patent is extended or adjusted under 35 U.S.C. 154(b) by 3 days.

(21) Appl. No.: 14/783,492

(22) PCT Filed: Apr. 11, 2013

(86) PCT No.: PCT/JP2013/060977
§ 371 (c)(1),
(2) Date: Oct. 9, 2015

(87) PCT Pub. No.: WO2014/167694
PCT Pub. Date: Oct. 16, 2014

(65) Prior Publication Data

US 2016/0053641 A1 Feb. 25, 2016

(51) Int. Cl.
*F01L 3/14* (2006.01)
*F01L 3/20* (2006.01)

(52) U.S. Cl.
CPC .. *F01L 3/14* (2013.01); *F01L 3/20* (2013.01)

(58) Field of Classification Search
CPC ..... F01L 3/08; F01L 3/12; F01L 3/18; F01L 3/20; F01L 3/22; F01L 7/08; F01L 7/10
USPC ..... 123/188.1–188.3; 137/340
See application file for complete search history.

(56) References Cited

U.S. PATENT DOCUMENTS 1,984,728 A 12/1934 Colwell
1,984,751 A 12/1934 McBride et al.
2,009,996 A 8/1935 Gering, Jr.
2,274,667 A 3/1942 Colwell
2,365,285 A * 12/1944 McDill ..... F01L 3/02 141/5

(Continued)

FOREIGN PATENT DOCUMENTS

JP S62-062071 A 3/1987
JP 62-102806 U 6/1987

(Continued)

OTHER PUBLICATIONS

Machine translation of JP3018260B2.*

(Continued)

*Primary Examiner* — Long T Tran
(74) *Attorney, Agent, or Firm* — Foley & Lardner LLP

(57) ABSTRACT

A hollow poppet valve (10) having an improved heat transfer capability is provided. The valve has an internal cavity (S), extending from within a valve head (14) into a stem (12) of the valve, is loaded with a coolant (19) together with an inert gas. The coolant in the valve head (14) is stirred by swirl flows of the coolant generated during reciprocal motions of the valve. A multiplicity of swirl-forming protrusions are formed on at least on one of the bottom and the ceiling of the valve head cavity (S1) in such a way that swirl flows (F20, F30) of coolant are generated by the protrusions in the valve head cavity (S1) during reciprocal motions of the valve to thereby stir the coolant in the circumferential direction of the cavity (S1).

8 Claims, 9 Drawing Sheets

(56) References Cited

U.S. PATENT DOCUMENTS

| | | | | | |
|---|---|---|---|---|---|
| 2,369,063 | A * | 2/1945 | McDill | F01L 3/02 | 123/188.3 |
| 2,392,175 | A | 1/1946 | Norton | | |
| 2,403,926 | A | 7/1946 | Thompson | | |
| 2,410,190 | A * | 10/1946 | Townhill | B23P 13/00 | 123/188.3 |
| 2,411,764 | A | 11/1946 | Thoren | | |
| 2,450,803 | A | 10/1948 | Johnson | | |
| 2,471,937 | A | 5/1949 | Colwell | | |
| 2,544,605 | A | 3/1951 | Marion | | |
| 2,682,261 | A | 6/1954 | Achor | | |
| 4,147,138 | A * | 4/1979 | Haug | F01L 3/18 | 123/188.3 |
| 5,168,843 | A * | 12/1992 | Franks | F01L 3/085 | 123/188.2 |
| 5,413,073 | A | 5/1995 | Larson et al. | | |
| 5,769,037 | A * | 6/1998 | Ohtsubo | F01L 3/14 | 123/188.9 |
| 5,771,852 | A * | 6/1998 | Heimann, Jr. | B23P 15/002 | 123/188.11 |
| 6,912,984 | B2 | 7/2005 | Narasimhan et al. | | |
| 7,160,468 | B2 | 1/2007 | Matsuzaki | | |
| 7,311,068 | B2 * | 12/2007 | Jackson | F01L 1/28 | 123/188.2 |
| 7,344,655 | B1 | 3/2008 | Nishii et al. | | |
| 2007/0240696 | A1 * | 10/2007 | Jackson | F01L 1/28 | 123/79 C |
| 2008/0006793 | A1 | 1/2008 | Hirnschal | | |
| 2009/0020082 | A1 | 1/2009 | Suzuki et al. | | |
| 2012/0246934 | A1 * | 10/2012 | Morii | F01L 3/00 | 29/890.12 |
| 2014/0352803 | A1 * | 12/2014 | Onuma | F01L 3/16 | 137/340 |

FOREIGN PATENT DOCUMENTS

| | | | | |
|---|---|---|---|---|
| JP | 1-173305 | U | 12/1989 | |
| JP | H03-023607 | U | 3/1991 | |
| JP | 4-76907 | U | 7/1992 | |
| JP | 3-52309 | U | 5/1993 | |
| JP | 3018260 | B2 * | 3/2000 | F01L 3/14 |
| JP | 2006-097499 | A | 4/2006 | |
| JP | 2008-014237 | A | 1/2008 | |
| JP | 2011-179328 | A | 9/2011 | |
| WO | WO 2010/041337 | A1 | 4/2010 | |

OTHER PUBLICATIONS

Tsuneishi: U.S. Office Action on U.S. Appl. No. 14/759,850 dated Jul. 29, 2016.

U.S. Appl. No. 14/759,850, filed Jul. 8, 2015, Tsuneishi et al.

Tsuneishi: U.S. Notice of Allowance on U.S. Appl. No. 14/759,850 dated Nov. 23, 2016.

* cited by examiner (a)

(b)

(a)

(b)

HOLLOW POPPET VALVE

FIELD OF THE INVENTION

This invention relates to a hollow poppet valve comprising a valve head and a stem integral with the valve head, and more particularly, to a poppet valve having an internal cavity that comprises a diametrically large valve head cavity formed in the valve head and a diametrically small cavity formed in the stem in communication with the valve head cavity, and is charged with a coolant.

BACKGROUND ART

Patent Documents 1 and 2 listed below disclose hollow poppet valves comprising a valve head integrally formed at one end of a valve stem, the poppet valve formed with an internal cavity that extends from within a valve head into the stem and is charged, together with an inert gas, with a coolant that has a higher heat conductivity than the valve material. An example of such coolant is metallic sodium having a melting point of about 98° C.

Since this type of internal cavity extends from within the valve head into the stem and contains a large amount of coolant, it can advantageously enhance the heat conduction ability (hereinafter referred to as heat reduction capability) of the valve.

It is known that if the temperature of a combustion chamber of an engine is heated to an excessively high temperature during an operation, knocking may take place, which lowers the fuel efficiency and outputs, and hence the performance, of the engine. In order to lower the temperature of the combustion chamber, there has been proposed different types of hollow poppet valves which have an internal cavity loaded with a coolant together with an inert gas so as to positively conduct heat from the combustion chamber via such valve (i.e. a method of enhancing heat reduction effect of the valve to remove heat from the combustion chamber by enhanced heat reduction effect of the poppet valves).

PRIOR ART DOCUMENTS

Patent Documents

Patent Document 1: WO2010/041337
Patent Document 2: JPA Laid Open 2011-179328

SUMMARY OF THE INVENTION

Objects to be Achieved by the Invention

Conventional coolant-charged hollow poppet valves comprise a generally disk shape valve head cavity formed in its valve head in communication with a linear stem cavity formed in its stem via a smooth interconnecting region having a gradually changing inner diameter between the two cavities, so that a (liquefied) coolant and an inert gas charged in the two cavities can move smoothly between the two cavities during a reciprocal motion of the valve, thereby facilitating an anticipated heat reduction capability of the valves.

However, since the (liquefied) coolant can move smoothly between the two cavities across the interconnecting region in response to a reciprocal motion of the valve, upper, middle, and lower layers of coolant in the internal cavity can smoothly move in the axial direction of the valve without getting intermixed.

Consequently, thermal energy stored in lower layers of the coolant (near a combustion chamber) is not positively transferred to middle and upper layers of the coolant, so that heat reduction capability (or heat conduction ability) of the valves is not fully achieved.

In an effort to solve this problem, the inventors of the present invention have found that an inertial force that acts on the coolant during a reciprocal motion of the valve (in the axial direction of the valve) may be utilized to cause a horizontal swirl flow of coolant (hereinafter referred to as swirl flow or simply swirl) in a valve head cavity.

It is known that the coolant is subjected to an upward or downward inertial force during a reciprocal motion of the valve in its axial direction to open/close an intake/exhaust port, and is moved by the inertial force in the axial direction. Hence, if, for example, one or more of radial protrusions, each formed with a sloping face inclined in the circumferential direction of the valve, are provided on the bottom of the valve head cavity, the coolant will be supposedly pushed in the circumferential direction by the sloping faces, generating a swirl flow in a lower layer of the coolant, particularly when the valve is moving upward to open the port, thereby increasing stirring of the coolant, and hence the heat reduction capability of the valve.

In view of the foregoing prior art problem, it is an object of the present invention to provide an improved hollow poppet valve based on our aforementioned finding, the poppet valve being capable of forming a swirl flow of coolant in the valve head cavity during a reciprocal motion of the valve that enhances stirring of the coolant in its internal cavity to improve the heat reduction capability of the valve.

Means to Achieve Objects

To achieve the object above, there is provided in accordance with the invention as recited in claim 1 a hollow poppet valve, comprising:

a stem;

a valve head integrally formed at one end of the stem, and an internal cavity that extends from inside the valve head into the stem, the internal cavity loaded with a coolant together with an inert gas, wherein the internal cavity has a diametrically large cavity in the valve head (the cavity hereinafter referred to as valve head cavity) and a diametrically small linear cavity formed in the stem (the linear inner cavity hereinafter referred to as stem cavity) in communication with a central region of the valve head cavity, and wherein a multiplicity of swirl-forming protrusions are formed on either a bottom or a ceiling of the valve head cavity, the swirl-forming protrusions being spaced apart at substantially equal intervals in a circumferential direction of the valve head cavity, the protrusion each having a sloping face inclined in the circumferential direction to generate a swirl flow of coolant around the central axis during a reciprocal motion of the valve in a direction of its central axis.

(Function) In response to a reciprocal motion in an axial direction of the valve to open/close an intake/exhaust port, the coolant in the inner cavity is subjected to an inertial force in the axial direction, which moves the coolant in the axial direction. Specifically, when the valve is in a downward motion to open the intake/exhaust port, the (liquefied) coolant is subjected to an upward inertial force, so that the (liquefied) coolant is moved upward towards the ceiling of the valve head cavity, as shown in FIG. 4(*a*). Particularly when swirl-forming protrusions are provided on the ceiling of the valve head cavity, the sloping faces of the protrusions force the coolant in the direction of the inclination, generating circumferential flows F32, which turn out to be a swirl flow F30 of coolant created in an upper layer in the valve head, as shown in FIG. 3.

On the other hand, when the valve is in an upward motion to close the intake/exhaust port, the (liquefied) coolant is subjected to a downward inertial force as shown in FIG. 4(*b*), which causes the (liquefied) coolant to be moved downward towards the bottom of the valve head cavity. Consequently, with the swirl-forming protrusions provided on the bottom of the valve head cavity each having a sloping face inclined in the circumferential direction, circumferential flows F22 of coolant are generated along the sloping faces of the protrusions (that is, in the circumferential direction), resulting in a swirl flow F20 of coolant in a lower layer in the valve head cavity, as shown in FIG. 3.

In this manner, a swirl flow of coolant is generated at least in either an upper layer or a lower layer of the coolant in response to a reciprocal motion of the valve, stirring the layer actively, to enhance the heat transfer by the coolant in the valve head.

Specifically, under repeated reciprocal axial motions of the valve, the coolant gets mixed with the inert gas in the internal cavity and rotated in the circumferential direction by a swirl flow generated in response to the reciprocal motion of the valve in the valve head cavity. Meanwhile, the coolant in the stem cavity begins to rotate in the circumferential direction as it is 'pulled' by the coolant swirling in the valve head cavity. Since the centrifugal force acting on the coolant is larger in the valve head cavity than in the stem cavity, a pressure drop in the coolant is greater in the former cavity than in the latter cavity, so that a whirlpool F40 is generated in the stem cavity as shown in FIG. 2, which whirlpool causes the coolant and the inert gas in the stem cavity to be attracted into the valve head cavity.

Firstly, therefore, a certain amount of coolant flows from the stem cavity into the valve head cavity, facilitating stirring of the coolant in the internal cavity.

Secondly, such swirl flows cause the (uppermost) level of the liquefied coolant in the stem cavity to be raised, which helps increase the area of the wall of the stem cavity in contact with the coolant, thereby increasing the heat conduction ability of the stem.

In the hollow poppet valve recited in claim 1, the swirl-forming protrusions may be provided on the bottom as well as on the ceiling of the valve head cavity with the sloping faces of the protrusions.

(Function) As the coolant in the valve head cavity is driven by a swirl generated by a reciprocal motion of the valve and rotated in the circumferential direction, the direction of the swirl generated in an upper layer of the coolant during a downward motion of the valve and that of the swirl generated in a lower layer of the coolant during an upward motion of the valve are the same, the entire coolant in the valve head cavity is actively stirred by the swirls during reciprocal motion of the valve, further enhancing the heat transfer by the coolant within the valve head cavity.

Specifically, the coolant in the valve head cavity is driven in a given circumferential direction by a swirl generated by a downward motion of the valve, and further accelerated in the same circumferential direction by a swirl generated in an upward motion of the valve. Thus, the coolant acquires an appreciable angular momentum in the valve head, which lowers the pressure in the valve head cavity than in the stem cavity, so that the coolant in the stem cavity is surely drawn, together with the inert gas, in a whirlpool of coolant eddying into the valve head cavity.

Firstly, therefore, coolant is inevitably drawn from the stem cavity into the valve head cavity, thereby further facilitating stirring of the coolant in the internal cavity.

Secondly, the (highest) liquefied coolant level in the stem cavity is raised by the swirls, thereby increasing the area of the wall of the stem cavity in contact with the coolant and enhancing the heat conduction ability of the valve stem.

In the hollow poppet valve recited either in claim 1 or 2, the swirl-forming protrusions may be offset away from the periphery of the valve head cavity by a predetermined distance so as to allow the coolant to flow in an annular flow passage around the protrusions and along the periphery of the valve head cavity; and at the same time the sloping faces of the protrusions may be inclined towards the annular flow passage, as recited in claim 3.

(Function) Circumferential flows, generated by the respective sloping faces of the swirl-forming protrusions inclined in the circumferential direction of the protrusions, in response to a reciprocal motion of the valve are led to the annular passage along the periphery of the valve head cavity without interfering with the adjacent protrusions arranged in a circumferential direction, resulting in a smooth swirl flow in a lower or an upper layer of the coolant in the valve head cavity and along the periphery of the valve head cavity.

As stated above, the ceiling and the periphery of the valve head cavity are defined by the recess of the valve head recess, while the bottom of the valve head cavity is defined by a disk shape cap welded onto an open end of the recess. Thus, it is easy to provide swirl-forming protrusions integrally on a cap by forging, machining, and/or welding before the cap is welded to the valve head shell.

In the hollow poppet valve recited in any one of claims 1 through 3, the valve head cavity may be configured in a shape of a substantially truncated circular cone having a tapered inner periphery substantially parallel to the outer periphery of the valve head shell, and the stem cavity configured substantially perpendicular to the ceiling of the valve head cavity, whereby tumble flows of coolant in the valve head cavity are formed around the central axis of the valve during a reciprocal motion of the valve, as recited in claim 4.

(Function) In response to a reciprocal motion of the valve in its axial direction, the coolant in the internal cavity is moved by an inertial force in the opposite axial direction. Since the valve head cavity has a substantially truncated-circular-cone shape, such axial motion of the coolant creates a pressure gradient in the valve head cavity, which in turn generates a tumble flow of coolant in the valve head cavity.

Specifically, when the valve is in a downward motion to open an intake/exhaust port, the entire coolant in the liner stem cavity is smoothly moved upward by an upward inertial force, as shown in FIG. 4(*a*), while in the valve head cavity a turbulent flow F4 is generated near the interconnecting region with the valve head due to an eave shape annular step 15 near the interconnecting region, as shown in FIG. 5(*a*). On the other hand, as show in FIG. 4(*a*), since the upward inertial force acting on the coolant is larger in a central region than in a peripheral region of the valve head cavity, coolant in the central region of the valve head cavity is moved towards the ceiling and further along the periphery of the valve head cavity (flows F1), as shown in FIG. 5(*a*). In this instance, near the bottom of the valve head cavity, coolant in the central region is moved upward, creating a negative pressure in the central region, which generates radially inward flows F3, which in turn generate downward flows F2 along the tapered periphery of the valve head cavity.

In other words, vertical outer perimetric circulatory flows T1 of coolant (hereinafter referred to as outer perimetric tumble flows T1) are generated around the central axis of the valve, as indicated by a sequence of arrows F1→F2→F3→F1.

When the valve is in an upward motion to close the intake/exhaust port, the (liquefied) coolant in the internal cavity is moved downward by an inertial force as shown in FIG. 4(*b*). In this instance, the entire coolant moved upward in the stem cavity when the valve was opened can move downward smoothly, but at the interconnecting region with the valve head cavity, a turbulent flow F5 is generated. On the other hand, since a larger inertial force acts on the coolant in a central region of the valve head cavity than in peripheral regions as shown in FIG. 4(*b*), radially outward flows F6 are generated along the bottom of the valve head cavity, as shown in FIG. 5(*b*). Meanwhile, coolant in a central region of the valve head cavity is moved downward, creating a negative pressure in the central region, which in turn generates radially inward flows F8, and upward flows F7 along the tapered periphery of the valve head cavity.

Thus, vertical inner perimetric circulatory flows T2 of coolant (the flows hereinafter referred to as inner perimetric tumble flows T2) are generated in the valve head cavity around the central axis of the valve, as indicated by a sequence of arrows F6→F7→F8→F6.

In this way, during reciprocal motions of the valve, tumble flows T1 and T2 are generated in the valve head cavity as shown in FIG. 5(*a*)-(*b*) in addition to the swirl flows F20 and F30 shown in FIGS. 2 and 3, all together actively stirring upper, middle, and lower layers of coolant in the valve head cavity, and significantly improve the heat reduction capability (heat conduction ability) of the valve.

Effect of the Invention

According to the invention, a swirl flow is generated in the valve head cavity during a reciprocal motion of the valve, which helps rotate the coolant in the stem cavity in a circumferential direction, intermixing coolant layers therein, so that the heat reduction capability (heat conduction ability) of the valve is improved due to enhancing the heat transfer by the coolant in the inner cavity, and hence the engine performance also, is improved.

According to the invention as recited in claim 2, vigorous swirl flows are generated in the valve head cavity during reciprocal motions of the valve, which help rotate the coolant in the stem cavity actively in circumferential directions, stirring the coolant therein, so that the heat reduction capability (heat conduction ability) of the valve is improved due to enhancing the heat transfer by the coolant in the inner cavity, and hence the engine performance also, is further improved.

According to the invention as recited in claim 3, a smooth swirl flow of coolant along the periphery of the valve head cavity is generated in a lower or an upper region of the valve head cavity, which infallibly stirs the coolant in the valve head cavity and facilitates heat transfer within the internal cavity, hence enhancing the heat reduction capability (heat conduction ability) of the valve. The engine performance is improved accordingly.

According to the invention as recited in claim 4, since tumble flows are generated in the valve head cavity, along with a swirl flow generated in a reciprocal motion of the valve, the entire coolant is actively stirred in the inner cavity, thereby enhancing the heat transfer by the coolant in the inner cavity, further improving the heat reduction capability (heat conduction ability) of the valve, and hence the engine performance is improved accordingly.

BRIEF DESCRIPTION OF THE DRAWINGS

FIG. 6(*b*), a step of drilling a hole in the valve stem that corresponds to a stem cavity near the valve head (the cavity hereinafter referred to as valve-head side stem cavity); FIG. 6(*c*), a step of drilling a hole in the valve stem that corresponds to a stem cavity near the end of the valve stem (the cavity hereinafter referred to as stem-end side stem cavity); FIG. 6(*d*), a stem-end-welding step in which a stem end member is welded; FIG. 6(*e*), a step of loading a coolant in the stem cavity; and FIG. 6(*f*), a valve-head-cavity sealing step, in which a cap is welded to an open end of a recess formed in the valve head shell to seal the recess to form a valve head cavity;

FIG. 9(*b*), a step of drilling a hole that corresponds to a stem cavity; FIG. 9(*c*), a step of loading a coolant in the stem cavity; and FIG. 9(*d*), a valve-head-cavity sealing step, in which a cap is welded to an open end of a recess formed in the valve head shell to seal the recess to form a valve head cavity;

BEST MODE FOR CARRYING OUT THE INVENTION

Figure 1:
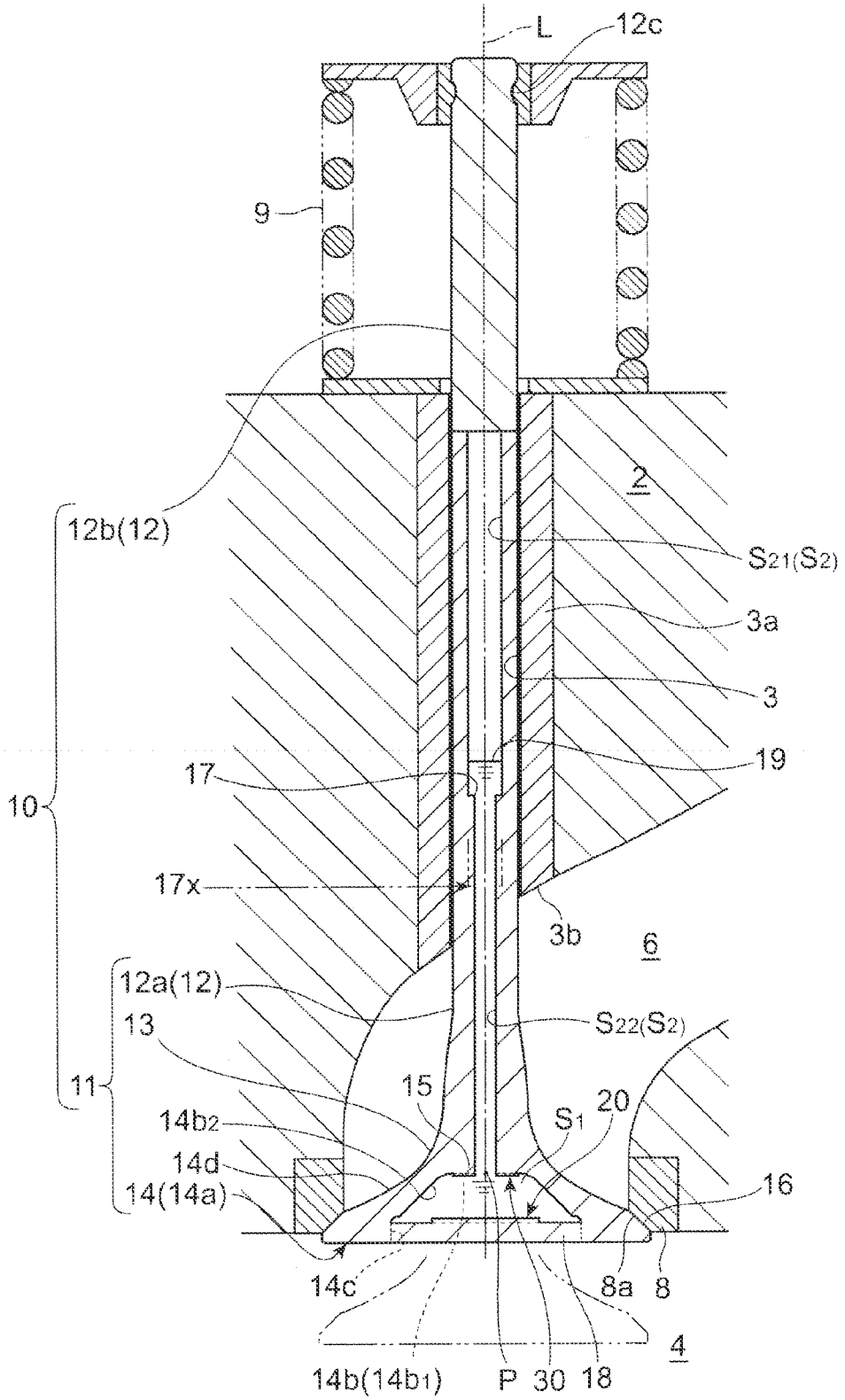
FIG. 1 is a longitudinal cross section of a hollow poppet valve in accordance with a first embodiment of the invention.

The present invention will now be described in detail by way of example with reference to a few embodiments.

Referring to FIGS. 1 through 6, there is shown a hollow poppet valve for an internal combustion engine in accordance with a first embodiment of the invention.

In these figures, reference numeral 10 indicates a hollow poppet valve made of a heat resisting metal. The valve 10 has a straight stem 12 and a valve head 14 integrated with the stem 12 via a tapered curved fillet 13 that has an outer diameter (that increases towards the valve head). Provided in the peripheral region of the valve head 14 is a tapered valve seat 16.

Figure 6:
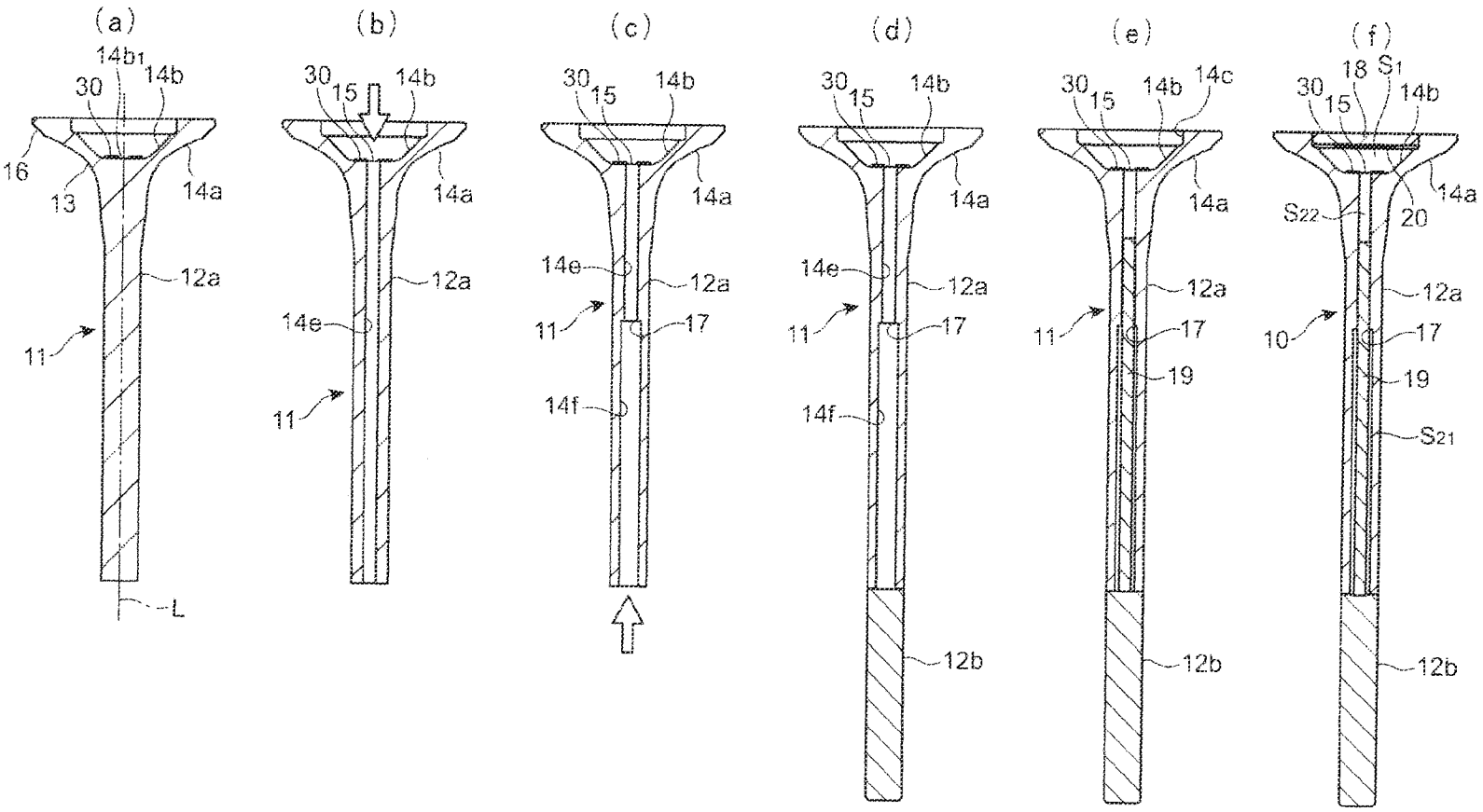
FIG. 6 shows steps of manufacturing a hollow poppet valve. More particularly, FIG. 6(*a*) shows a step of hot forging a valve shell of an intermediate valve product.

Specifically, a hollow poppet valve 10 comprises a valve-head-stem integral shell 11 having a cylindrical stem 12*a*, a valve head shell 14*a* formed at one end of the stem 12*a*, a stem end member 12*b* welded to another end of the stem 12*a*, and a disk shape cap 18, as shown in FIGS. 1 and 6. The valve head shell 14*a* has a generally truncated-circular-cone shape recess 14*b*, which is sealed with the cap 18 welded onto an inner periphery 14*c* of the recess 14*b*. Thus, the hollow poppet valve 10 has an internal hollow space S that extends from within the valve head 14 into the valve stem 12. The hollow space S is charged with a coolant 19, such as metallic sodium, together with an inert gas such as argon. It is true in principle that the heat reduction capability of the valve increases with the amount of coolant loaded in the internal cavity S. In actuality, however, the heat reduction capability will not increase with the amount of the coolant if the amount exceeds a certain level, only to increase its cost. Thus, from the point of cost-performance (cost/mass ratio of the coolant charged), it is preferred to load the internal cavity S with an optimum amount of coolant, which is, in volume ratio, in the range from 1/2 to 4/5 of the cavity S.

As shown in FIG. 1, a cylinder head 2 of the engine has an exhaust port 6 which extends from a combustion chamber 4. An annular valve seat insert 8 is provided at the entrance of the exhaust port 6 and has a tapered face 8*a* that allows the tapered valve seat 16 of the valve 10 to be seated thereon. There is provided in the cylinder head 2 a valve insertion hole 3, the inner periphery of which is provided with a valve guide 3*a* for slidably receiving the valve stem 12. The hollow poppet valve 10 is urged by a valve spring 9 to close the port. A keeper groove 12*c* is formed at one end of the valve stem.

Since the shell 11 and the cap 18 are subjected to a high temperature gas in the combustion chamber and in the exhaust port 6, they are made of a heat resisting steel, while the stem member 12*b* can be made of a standard steel since the stem member 12*b* is not required to have such heat resistance as the shell 11 and the cap 8, although it is required to have a sufficient mechanical strength.

A mechanism by which a tumble flow (vertical circulatory flow) of coolant 19 is generated in the valve head cavity S1 in response to a reciprocal motion of the valve 10 will now be described below.

The internal cavity S of the valve 10 comprises a diametrically large valve head cavity S1 in the form of a truncated-circular-cone and a diametrically small linear cavity S2 formed in the stem 12 (the linear internal cavity hereinafter referred to as stem cavity S2) such that the valve head cavity S1 and the stem cavity S2 are communicated at a right angle. The circular ceiling 14*b*1 of the valve head cavity S1 (that is, the bottom of the truncated circular cone shape recess 14*b* of the valve head shell 14*a*, or the peripheral area of the open end of the stem cavity S2), is a planar face perpendicular to the central axis L of the hollow poppet valve 10.

There is provided between the valve head cavity S1 and the stem cavity S2 an interconnecting region P which has an eave shape annular step 15 as viewed from the valve head cavity S1, in place of a smooth interconnecting region as disclosed in the prior art documents 1 and 2. The annular step 15 is provided with a flat face which faces the valve head cavity S1 (or facing the bottom 14*b*1 of the recess 14*b*) and is perpendicular to the central axis L of the valve 10. In other words, the annular step 15 is defined by a circular peripheral region around the open end of the stem cavity S2 (formed on the bottom 14*b*1 of the truncated-circular-cone shape recess 14*b*) and the inner periphery of the stem cavity S2.

Thus, it is noted that, in the valve 10 formed with a truncated-circular-cone shape cavity S1, the coolant 19 is adapted to be moved in the axial direction in the internal cavity S by the inertial force that acts on the coolant during a reciprocal motion of the valve in its axial direction, as describe in detail later. As the coolant 19 is moved in the axial direction of the valve head cavity S1, a pressure difference occurs in the valve head cavity S1, generating tumble flows T1 and T2 of coolant 19 as indicated by sequences of arrows F1→F2→F3 (FIG. 5(*a*)) and F6→F7→F8 (FIG. 5(*b*)), while in the stem cavity S2 turbulent flows F4 and F5 of coolant 19 are generated near the interconnecting region P.

In other words, the tumble flows T1 and T2 and the turbulent flows F4 and F5 generated during reciprocal motions of the valve actively intermix lower, middle and upper layers of the coolant 19 in the internal cavity S, enhancing the heat reduction capability (heat conduction ability) of the valve.

In this embodiment in particular, since the circular ceiling 14*b*1 of the valve head cavity S1 (which is the upper end face of the recess 14*b*) and the conic periphery 14*b*2 of the recess make an obtuse angle, smooth circulatory flows F1→F2 of coolant 19 can be easily established along the ceiling of the valve head cavity S1 and the periphery 14*b*2, and so are the flows F7→F8 along the periphery 14*b* and the ceiling, which stimulate tumble flows T1 and T2 in the coolant 19 in the valve head cavity S1. Thus, stirring of the coolant in the internal cavity S is greatly enhanced by the tumble flows, thereby significantly improving the heat reduction capability (heat conduction ability) of the valve 10.

Next, a mechanism by which a swirl (horizontal circulatory flow) of coolant 19 is generated in the valve head cavity S1 during a reciprocal motion of the valve 10 will now be described in detail.

Figure 2:
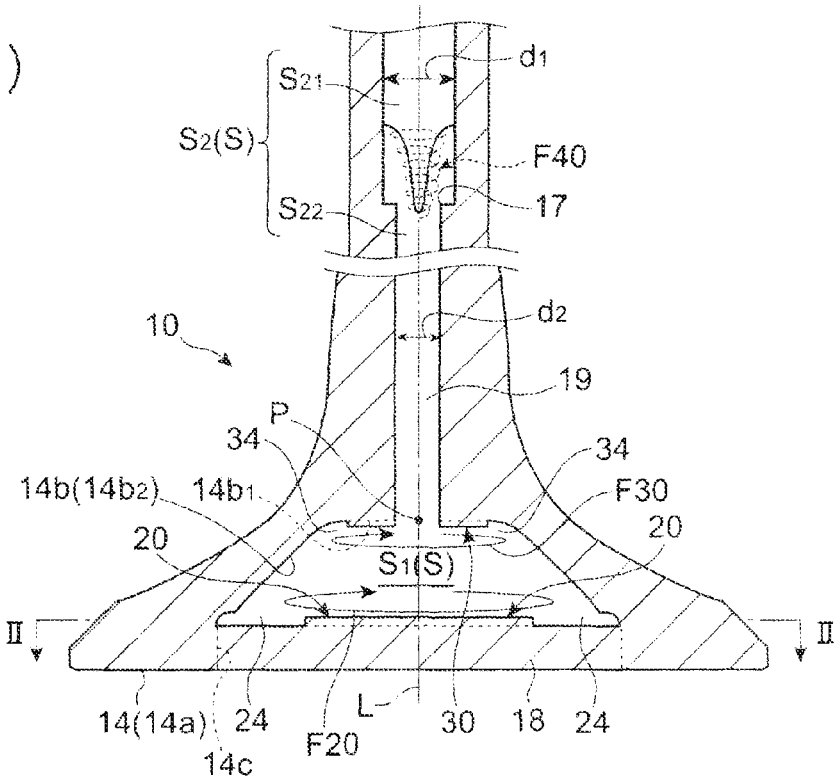
FIG. 2(*a*) is an enlarged longitudinal cross section of the hollow poppet valve, and FIG. 2(*b*) is a transverse cross section of the valve taken along line II-II in FIG. 2(*a*).
Figure 2:
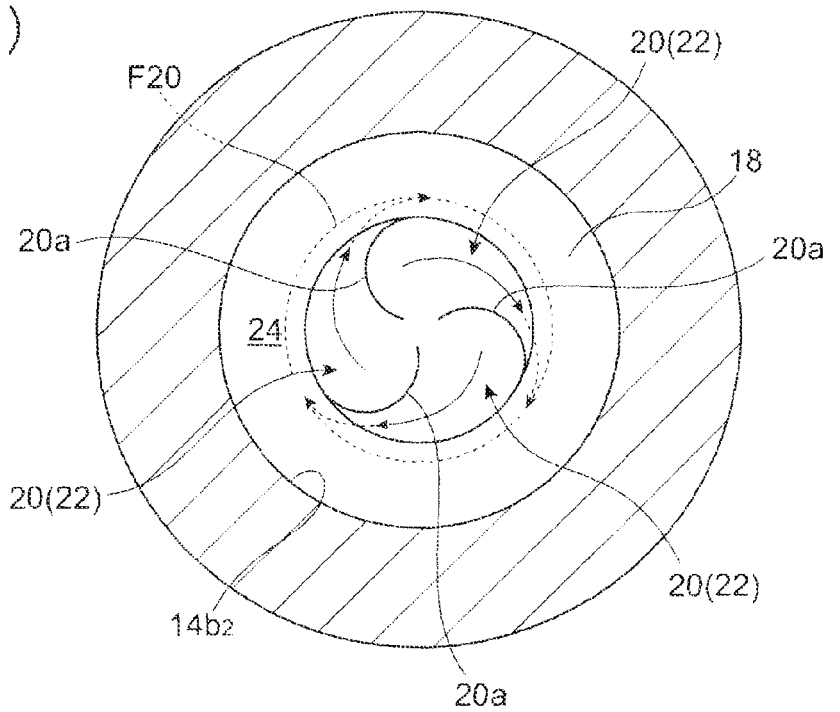
Figure 3:
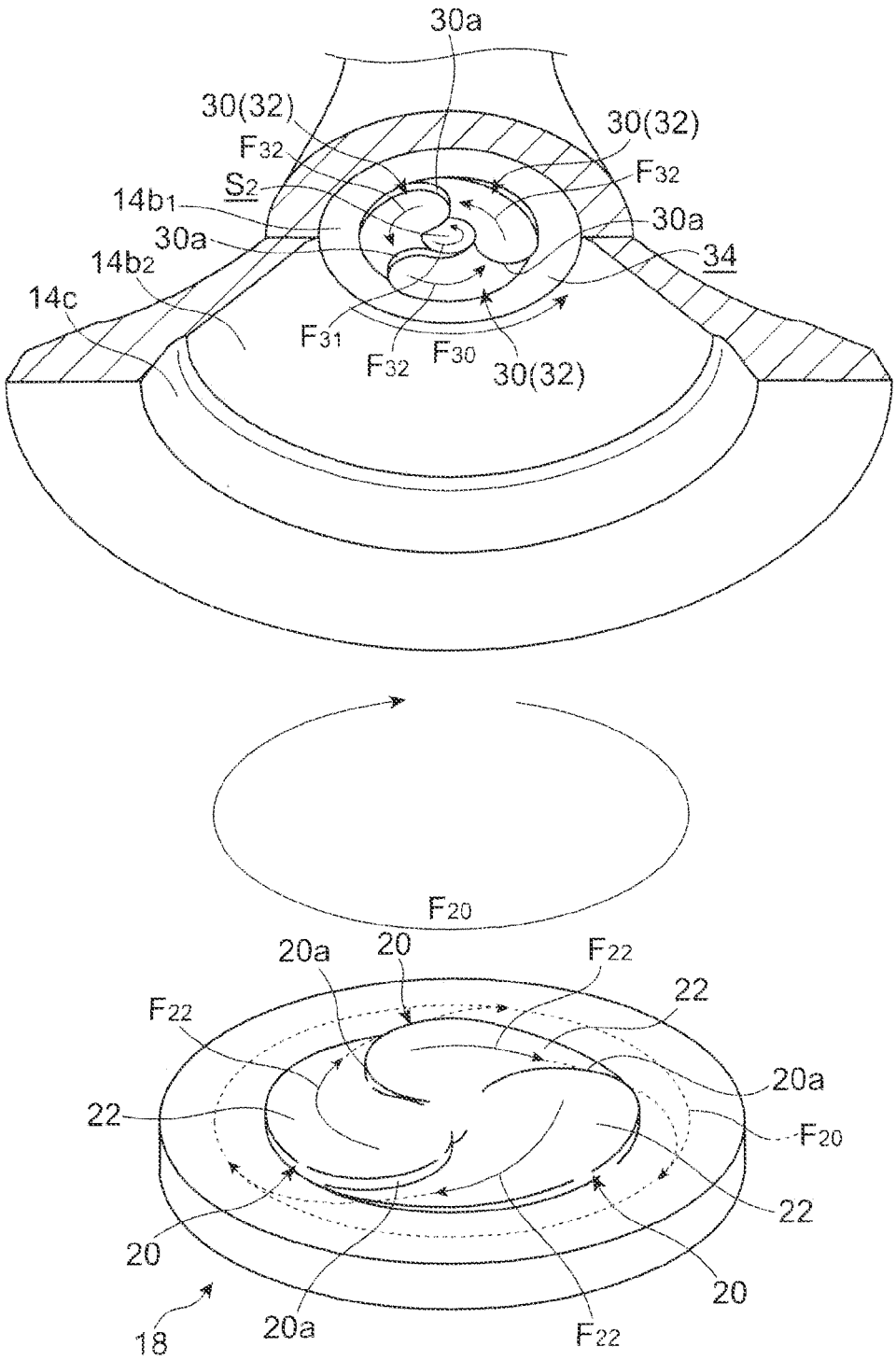
FIG. 3 shows an enlarged perspective view of a valve head of the hollow poppet valve formed with swirl-forming protrusions on the bottom and the ceiling of the valve head cavity.

As shown in FIGS. 2 and 3, the backside of the cap 18 which composes the bottom of the valve head cavity S1 is provided with three swirl-forming protrusions 20 each having a sloping face 22 inclined in the circumferential direction of the cavity. Similarly, the peripheral region 14*b*1 round the open end of the stem cavity S2 that is the ceiling of the valve head cavity S1 (the upper face of the truncated-circular-cone) is provided with swirl-forming protrusions 30 each having a sloping face 32 inclined in the circumferential direction of the cavity. These protrusions are spaced apart at equal intervals in the circumferential directions.

In particular, as shown in FIGS. 2 and 3, the swirl-forming protrusions 20 that formed with sloping faces 22 inclined in the clockwise circumferential direction are provided on a central region of the bottom of the valve head cavity S1, while the swirl-forming protrusions 30 formed with sloping faces 32 inclined in the counterclockwise circumferential direction are provided on the ceiling of the valve head cavity S1 around the open end of the interconnecting region P adjacent the stem cavity S2.

Thus, in the valve 10 provided with such swirl-forming protrusions 20 and 30 on the bottom and on the ceiling of the valve head cavity S1, respectively, the coolant 19 is moved in the internal cavity S by an inertial force in an axial direction of the valve 10 during a reciprocal motion of the valve 10, as described in more detail.

In the valve head cavity S1, swirl flows F22 and F32 are generated along the sloping faces 22 and 32 of the swirl-forming protrusions 20 and 30, respectively, as the coolant 19 is pushed by the protrusions as shown in FIGS. 2 and 3. These flows F22 and F32 merge into swirl flows of coolant F20 and F30 in the lower and upper regions of the valve head cavity S1. Consequently, the coolant 19 in the valve head cavity S1 is well stirred in the circumferential flows in the valve head cavity S1, thereby greatly enhancing the heat reduction capability (heat conduction ability) of the valve 10.

In this embodiment in particular, firstly, since the sloping faces 22 of the swirl-forming protrusions 20 formed on the bottom of the valve head cavity S1 are inclined in the circumferential direction in the vertically reverse direction of the sloping face 32 of the swirl-forming protrusions 30 formed on the ceiling (or the upper end face) 14*b*, clockwise circumferential swirl flows F20 and F30 are generated in a lower portion and an upper portion, respectively, of the coolant 19 in the valve head cavity S1.

Consequently, the coolant in the valve head cavity S1 is entirely stirred by the clockwise flow, which helps promote heat transfer in the valve head cavity S1 by the coolant 19 and greatly improves the heat reduction capability (heat conduction ability) of the valve.

Specifically, the coolant 19 and the inert gas will become a mixture in the valve head cavity S1 as they are repeatedly driven by the swirl flows F20 and F30 in the clockwise circumferential direction during reciprocal motions of the valve 10. In the stem cavity S2, the coolant is rotated in the clockwise circumferential direction as the coolant is dragged by the coolant 19 in the valve head cavity S1. Particularly, since the swirl flow F30 in the valve head cavity S1 caused by an downward motion of the valve 10 is accelerated in the same circumferential direction by the swirl flow F20 caused by an upward motion of the valve 10, the coolant 19 is rotated vigorously in the internal cavity S. Further, since the centrifugal force that acts on the coolant 19 is larger in the valve head cavity S1 than in the stem cavity S2, the pressure of the coolant becomes lower in the valve head cavity S1 than in the stem cavity S2, so that a whirlpool F40 is generated as shown in FIG. 2, which draws the coolant 19 from the stem cavity S2 into the valve head cavity S1 together with the inert gas.

Consequently, the coolant 19 is urged to flow from the stem cavity S2 into the valve head cavity S1, stimulating stirring of the coolant in the internal cavity S.

It is noted that the (highest) liquid level of the coolant 19 in the stem cavity S2 is raised by the whirlpool 40 that lowers the central level of the coolant, thereby increasing the area of the wall of the stem cavity S2 in contact with the coolant 19, which in turn enhances heat conduction ability of the stem 12.

Secondly, the swirl-forming protrusions 20 and 30 are offset from the periphery 14*b*2 of the valve head cavity S1 by a predetermined distance as shown in FIGS. 2 and 3 in order to provide annular fluid passages 24 and 34 between the periphery 14*b*2 of the valve head cavity S1 and the swirl-forming protrusions 20 and 30. Each of the protrusions 20 and 30 extends radially outwardly and has an sloping face 22 or 32 which is inclined from its arcuate rear wall 20*a* or 30*a* (FIGS. 2 and 3), which is taller than the bottom and the ceiling of the valve head cavity S1. Particularly, each sloping face 22 of the protrusion swirl-forming protrusions 20 formed on the bottom of the valve head cavity S1 extends towards the surrounding annular fluid passage 24 along an arcuate rear wall 20*a* of the neighboring protrusion 20*a*, as shown in FIG. 2(*b*).

As a result, when the valve 10 is in a downward motion, the coolant 19 in the valve head cavity S1 is pushed by the sloping faces 32 of the swirl-forming protrusions 30, giving rise to the flows F32 along the sloping faces 32. Each of these flows F32 is guided outwardly from the sloping faces 32 and away from the arcuate rear wall 30*a* of the neighboring swirl-forming protrusions 30 in the downstream of the flow, and is largely led to the annular fluid passage 34 along the periphery 14*b*2 of the valve head cavity S1, so that, in upper layers of the coolant 19 in the valve head cavity S1, swirl flows F30 are generated smoothly in the annular passage 34 along the periphery 14*b*2 of the valve head cavity S1. In addition, the flow F32 along the sloping faces 32 is partly guided radially inwardly along the arcuate rear wall 30*a* and to the interconnecting region P between the valve head cavity S1 and the stem cavity S2, so that a swirl F31 is also generated in the interconnecting region P.

On the other hand, when the valve 10 is in an upward motion, the coolant 19 in the valve head cavity S1 is pushed by the sloping faces 22 of the swirl-forming protrusions 20, giving rise to flows F22 along the sloping faces 22. Since each of the flows F22 is guided, by the arcuate rear wall 20*a* of the neighboring downstream side swirl-forming protrusion 20, from a sloping face 22 to the fluid passage 24 along the periphery 14*b*2 of the valve head cavity S1, so that a swirl F20 along the annular fluid passage 24 of the periphery 14*b*2 of the valve head cavity S1 is smoothly formed in a lower layer of the coolant 19.

In this manner, by virtue of smooth formation of the swirl flows F20 and F30 in the valve head cavity S1, vigorous rotational flows of coolant 19 are generated in the valve head cavity S1 as well as in the stem cavity S2, resulting in a strong inflow of coolant 19 from the stem cavity S2 into the valve head cavity S1, which secures enhancement of stirring of coolant in the internal cavity S. At the same time, the maximum liquid coolant level in the stem cavity S2 is raised accordingly, which increases in area of the peripheral wall of the stem cavity S2 in contact with the coolant 19, thereby further enhancing the heat conduction ability of the valve stem 12.

Next, referring to FIG. 5(*a*)-(*b*), a mechanism which turbulent flows F9 and F10 are generated in the valve stem cavity S2 during reciprocal motions of the valve 10 will now be described.

It is noted that the valve stem cavity S2 comprises a cavity S21 having a larger inner diameter d1 near the end of the stem (the cavity S21 hereinafter referred to as stem-end side stem cavity S21) and a cavity S22 having a smaller inner diameter d2 near the valve head (the cavity S22 hereinafter referred to as valve-head side stem cavity S22), and that an annular step 17 is provided in between the stem-end side stem cavity S21 and the valve-head side stem cavity S22. The valve stem cavity S2 is partially loaded with coolant 19 to a level above the annular step 17.

Figure 5:
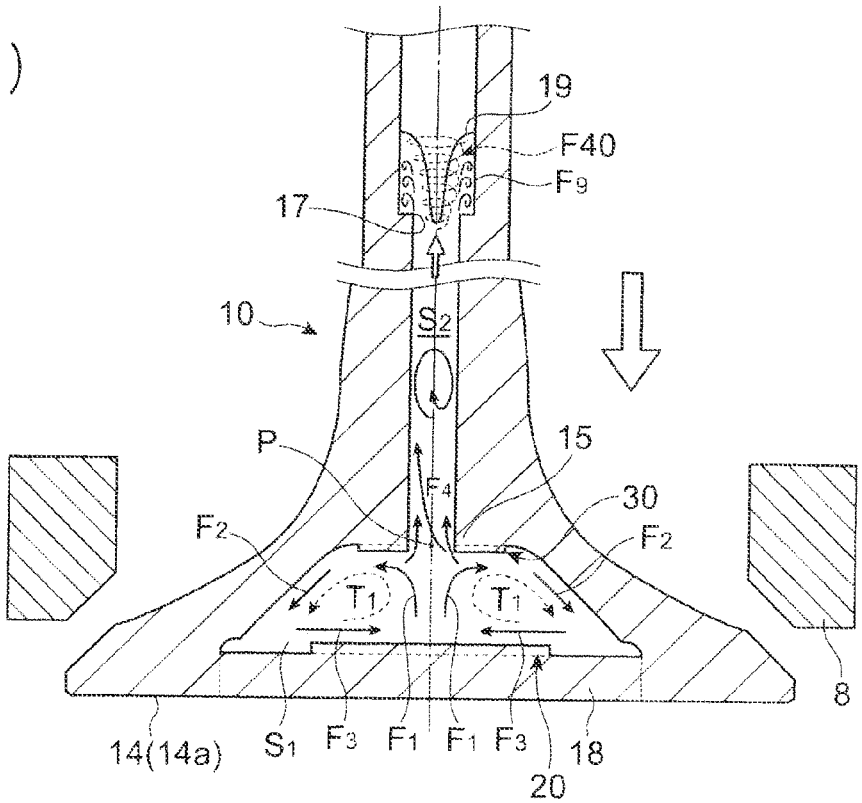
FIG. 5 shows enlarged views of the coolant during reciprocal motions of the hollow poppet valve. More particularly, FIG. 5(*a*) shows a movement of the coolant when the valve is in a downward motion to open the port, and FIG. 5(*b*) a movement of the coolant when the valve is in an upward motion to close the port.
Figure 5:
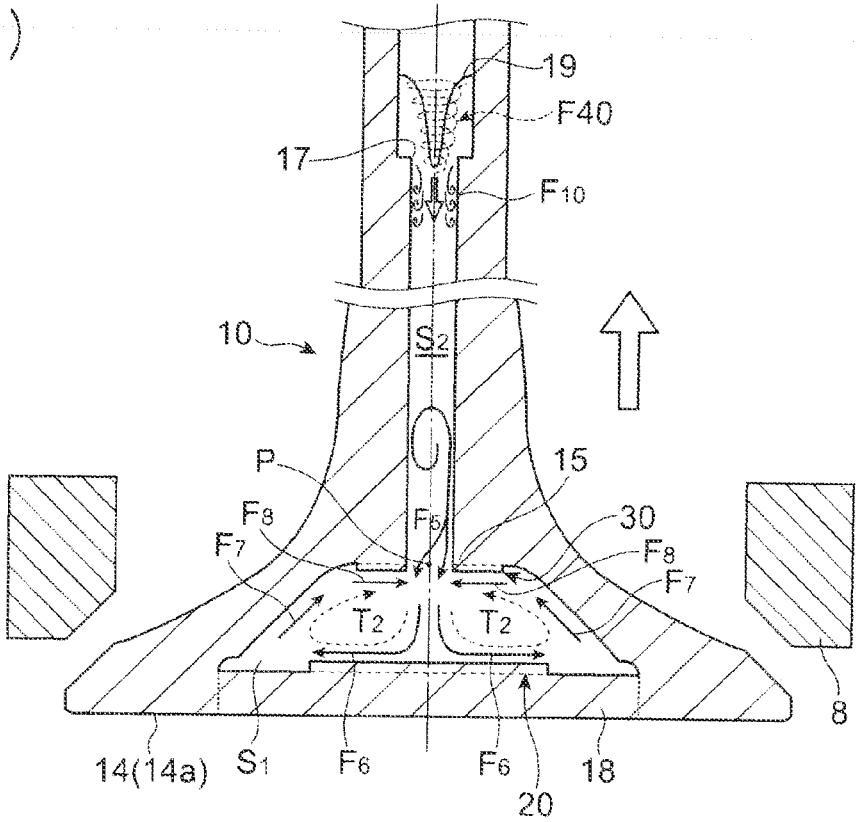

Consequently, turbulent flows F9 and F10 are generated in the coolant downstream of the step 17 as the coolant 19 in the valve stem cavity S2 is moved upward and downward by inertial forces acting on the coolant 19 during reciprocal motions of the valve, as shown in FIG. 5(*a*)-(*b*).

Next, behaviors of the coolant 19 in the internal cavity S during a reciprocal motion of the hollow poppet valve 10 will now be described in detail with reference to FIGS. 2, 3, 4, and 5.

Figure 4:
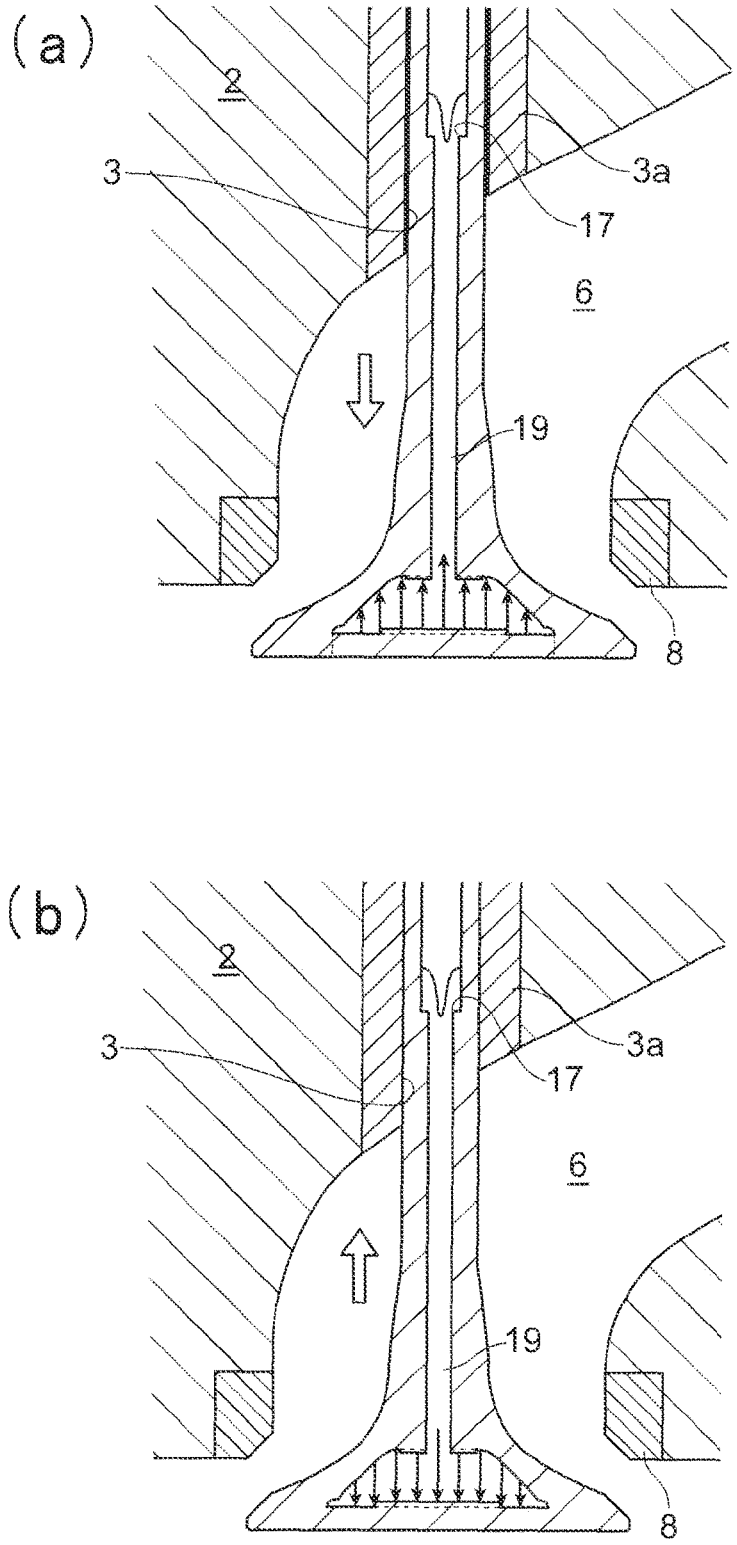
FIG. 4 shows inertial forces that acts on the coolant in the inner cavity during reciprocal motions of the valve in its axial directions. More particularly, FIG. 4(*a*) shows an inertial force during a downward motion of a valve to open a port, and FIG. 4(*b*) shows an inertial force during an upward motion of the valve to close the port.

When the valve is in a downward motion to open an intake/exhaust port, the (liquefied) coolant 19 in the valve head cavity S1 and stem cavity S2 is subjected to an upward inertial force and moved upward, as shown in FIG. 4(*a*).

However, since an cave shape annular step 15 is formed in the interconnecting region P between the valve head cavity S1 and the valve stem cavity S2, the coolant 19 in the valve head cavity S1 cannot move into the valve stem cavity S2 as smoothly as the hollow poppet valves disclosed in the prior art documents 1 and 2 which the interconnecting region P are formed smooth shape. Consequently, a turbulent flow of coolant F4 is generated in the stem cavity S2, in the neighborhood of the interconnecting region P, as shown in FIG. 5(*a*).

At the same time, a turbulent flow F9 is generated in the stem cavity S2 downstream of the step 17 as the coolant 19 moves from the diametrically smaller valve-head side stem cavity S22 to the diametrically larger stem-end side stem cavity S21, as shown in FIG. 5(*a*).

On the other hand, since a larger upward inertial force acts on the coolant 19 in a central region of the valve head cavity S1 than in its peripheral region as shown in FIG. 4(*a*), radially outward flows F1 of coolant 19 are generated along the ceiling of the valve head cavity S1, as shown in FIG. 5(*a*). In this instance, the coolant 19 in the central bottom region of the valve head cavity S1 is moved upward, rendering the pressure in the central region negative, which in turn gives rise to radially inward flows F3 and downward flows F2 along the tapered periphery 14*b*2 of the valve head cavity S1.

Thus, outer perimetric tumble flows T1 of coolant as indicated by a sequence of arrows F1→F2→F3→F1 are generate around the central axis L of the valve 10 in the valve head cavity S1.

Further, when the valve 10 is moved downward to open the intake/exhaust port, the (liquefied) coolant 19 which has moved to the ceiling of the valve head cavity S1 is pushed by the sloping faces 32 of the swirl-forming protrusions 30 of the ceiling and forced to flow along the sloping faces 32 as circumferential flows F32, that is, since the faces 32 are inclined in the circumferential direction, a circumferential swirl flow F30 results in an upper region of the valve head cavity S1, as shown in FIGS. 3 and 5(*a*).

Thus, the coolant 19 in the valve head cavity S1 rotates in the clockwise direction, dragging the coolant 19 in the stem cavity S2 in the same direction. In this case, since the pressure of the coolant becomes lower in the valve head cavity S1 than in the stem cavity S2 due to a larger centrifugal force acts on the coolant in the valve head cavity S1 than in the stem cavity S2, the coolant 19 is drawn, together with the inert gas, in a whirlpool F40 eddying from the stem cavity S2 into the valve head cavity S1 as shown in FIG. 2.

Furthermore, when the valve 10 is moved upward to close the port, the (liquefied) coolant 19 in the cavities S1 and S2 is subjected to a downward inertial force so that the coolant is moved downward as shown in FIG. 4(*b*).

It is noted that in the stem cavity S2 the entire coolant that has moved upward during a downward motion of the valve 10 can smoothly move downward. In the stem cavity, however, when the coolant moves from the diametrically larger stem cavity (stem-end side stem cavity) S21 into the diametrically smaller stem cavity (valve-head side stem cavity) S22, the coolant must pass through the step 17, whereby generating a turbulent flow F10 downstream of the step 17, as shown in FIG. 5(*b*). Furthermore, the downward flow of the coolant 19 generates a turbulent flow F5 also in the interconnecting region P adjacent the valve head cavity S1.

On the other hand, radially outward flows F6 of coolant are generated along the bottom of the valve head cavity S1 as shown in FIG. 5(*b*) due to a larger (downward) inertial force acting on the coolant in a central region than in a peripheral region of the valve head cavity S1 as shown in FIG. 4(*b*). In this case, due to the downward movement of the central coolant in the valve head cavity S1, the central pressure of the coolant becomes negative near the ceiling, resulting in radially inward flows F8, which accompany upward flows F7 along the tapered conic periphery 14*b*2 of the valve head cavity S1.

In other words, inner perimetric tumble flows T2 of coolant are generated around the central axis L of the valve 10 in the valve head cavity S1 as indicated by a sequence of arrows F6→F7→F8→F6.

When the valve 10 is moved upward to close the port, the liquefied coolant 19 that has moved to the bottom of the valve head cavity S1 is pushed by the sloping faces 22 of the swirl-forming protrusions 20 formed on the bottom of the valve head cavity S1, giving rise to flows F22 along the sloping faces 22 inclined in the circumferential direction, as shown in FIGS. 3 and 5(*b*). These flows grow into a circumferential swirl flows F20 of the coolant in a lower region of the valve head cavity S1.

Thus, the coolant in the valve head cavity S1 rotates in the clockwise circumferential direction, dragging the coolant in the stem cavity S2 in the same direction. Since a larger centrifugal force acts on the coolant in the valve head cavity S1 than in the stem cavity S2, a larger pressure drop takes place in the valve head cavity S1 than in the stem cavity S2, the coolant in the stem cavity S2 is drawn, together with the inert gas, in a whirlpool F40 swirling into the valve head cavity S1 as shown in FIG. 2.

In this way, in response to reciprocal motions of the valve 10, tumble flows T1 and T2 of the coolant are generated in the valve head cavity S1 along with swirl flows F20 and F30, which altogether activate stirring, and hence the heat transfer, of the coolant in the entire valve head cavity S1 is enhanced.

Specifically, the coolant not only in the valve head cavity S1 but also in the stem cavity S2 are stirred by the clockwise swirl flows F20 and F30 during reciprocal motions of the valve 10. In addition, inflow of coolant 19 from the stem cavity S2 into the valve head cavity S1 takes place due to the whirlpool F40 created in the stem cavity S2. Furthermore, as a result of stirring caused by vertical outer and inner perimetric flows of coolant 19 due to alternate upward and downward motions of the valve 10, heat transfer by the coolant is enhanced in the entire inner cavity S.

It should be appreciated that the diametrically large stem-end side stem cavity S21 has a large longitudinal length as shown in FIG. 1, and that the step 17 is located at an axial position of the stem cavity S2 that corresponds to a substantial end 3*b* of the valve guide 3 that faces the exhaust port 6 of the valve guide 3, so that the area of the valve stem 12 in contact with the coolant 19 is increased, thereby enhancing the heat conduction ability of the valve stem 12 and advantageously reducing the weight of the valve 10 by thinning the wall thickness of the stem cavity S21 without degrading the durability of the valve 10.

In short, the annular step 17 is located at a predetermined position which is chosen in such a way that the thin cavity wall of the diametrically larger portion S21 will never enter the exhaust port 6 and will not be subjected to a hot exhaust gas in the exhaust port 6, even when the valve is fully lowered to its lowest position shown by a phantom line in FIG. 1. 17X as shown in FIG. 1 indicates the position of the annular step 17 when the valve is fully lowered.

To be more specific, in view of the fact that the fatigue strength of a metal decreases with temperature and that a portion of the stem adjacent the valve head (the portion referred to as valve-head side stem portion) is constantly exposed to a hot gas in the heated exhaust port 6, it is necessary to provide the valve-head side stem portion with a sufficient wall thickness to retain its fatigue strength, by properly reducing the inner diameter d2 of the portion of the stem. On the other hand, unlike a valve-head side stem portion, a stem-end side portion of the valve stem is located away from the combustion chamber and will never be heated to a high temperature. Besides, the portion always remains in contact with a valve guide and heat is promptly dissipated from the stem-end side portion to the cylinder head via the valve guide if heat is transferred from the combustion chamber 4 or from the exhaust port 6 by the coolant 19, thereby preventing the stem-end side stem portion from being heated to a high temperature. Thus, it is possible to properly reduce the thickness of the wall of the stem-end side stem portion.

Thus, since the stem-end side stem portion is less likely to decrease its fatigue strength than the valve-head side stem portion, the former portion will not suffer from such a durability problem as fatigue failure if the wall thickness of the stem-end side stem portion (or stem-end side stem cavity S21) is decreased to increase the inner diameter of S21.

In this embodiment, therefore, firstly, in order to enhance the heat transfer efficiency of the valve stem 12, the entire surface area of the valve stem cavity S2 in contact with the coolant is increased by enlarging the inner diameter of the stem-end-side stem cavity S21. Secondly, the total weight of the valve 10 is reduced by increasing the total volume of the valve stem cavity S2.

The stem end member 12*b* is not required to have a high heat resistance as compared with the shell 11. The valve 10 may be supplied inexpensive price by using the stem end member 12*b* which is made of a less heat resisting but less expensive material than a material of shell 11.

Next, referring to FIG. 6, a process of manufacturing a hollow poppet valve 10 will now be described in detail.

Firstly, an intermediate product shell 11 is formed by hot forging such that the product shell 11 comprises a valve head shell 14*a* integral with a stem 12*a*, and a truncated-circular-cone shape recess 14*b*, as shown in FIG. 6(*a*). It is noted that in this forging the valve head shell 14*a* is configured to have a flat bottom 14*b*1 perpendicular to the stem 12*a* (or the central axis L of the shell 11), and that swirl-forming protrusions 30 are formed on the bottom 14*b*1 (bottom of the recess 14*b*), spaced apart at substantially equal intervals in the circumferential direction.

The hot forging may be an extrusion forging in which a heat resisting steel alloy block is repetitively extruded through different metallic dies to form the shell 11 which has swirl-forming protrusions 30 on the recess 14*b* of the valve head shell 14*a*, or an upset forging in which a heat resisting metallic steel bar is first upset by an upsetter to form at one end thereof a semi-spherical section, which is then forged with a forging die to form a valve head shell 14*a* of the shell 11 which has swirl-forming protrusions 30 at its recess 14*b*. In this hot forging, a curved fillet 13 is formed between the valve head shell 14*a* and the stem 12*a*, and a tapered valve seat 16 is formed on the outer periphery of the valve head shell 14*a*.

In the next drilling step, the shell 11 is set up with its recess 14*b* of the valve head shell 14*a* oriented upward as shown in FIG. 6(*b*), and a bore 14*e* that corresponds to a valve-head side stem cavity S22 is drilled in the stem 12*a* from the bottom surface 14*b*1 of the recess 14*b* of the valve head shell 14*a*.

In this drilling step, in order to construct a valve head cavity S1 in communication with a stem cavity S22, the recess 14*b* of the valve head shell 14*a* is communicated with the hole 14*e* such that an eave shape annular step 15 (as viewed from the recess 14*b*) is formed in a region interconnecting the recess 14*b* with the hole 14*e*.

In the next drilling step shown in FIG. 6(*c*), a hole 14*f* that corresponds to the stem-end side stem cavity S21 is drilled in the stem end of the shell 11, and a step 17 is formed in the stem cavity S2.

In the next stem-end-member welding step, a stem end member 12*b* is welded to the stem end of the shell 11, as shown in FIG. 6(*d*).

In the next coolant loading step, a predetermined amount of solidified coolant 19 is put into the hole 14*e* of the valve head shell 14*a* of the shell 11 as shown in FIG. 6(*e*).

Finally, in a cavity-sealing step, a cap 18, formed with swirl-forming protrusions 20 on the backside thereof, is welded (by resistance welding for example) to an open end of the inner periphery 14*c*, under an argon gas atmosphere thereby sealing the internal cavity S in the valve 10 as shown in FIG. 6(*f*). It is noted that the swirl-forming protrusions 20 can be formed integrally on the backside of the cap 18, utilizing any known method such as, for example, forging, machining, brazing, and welding. Alternatively, the cap may be welded by electron beam welding or laser beam welding in place of resistance welding.

Figure 7:
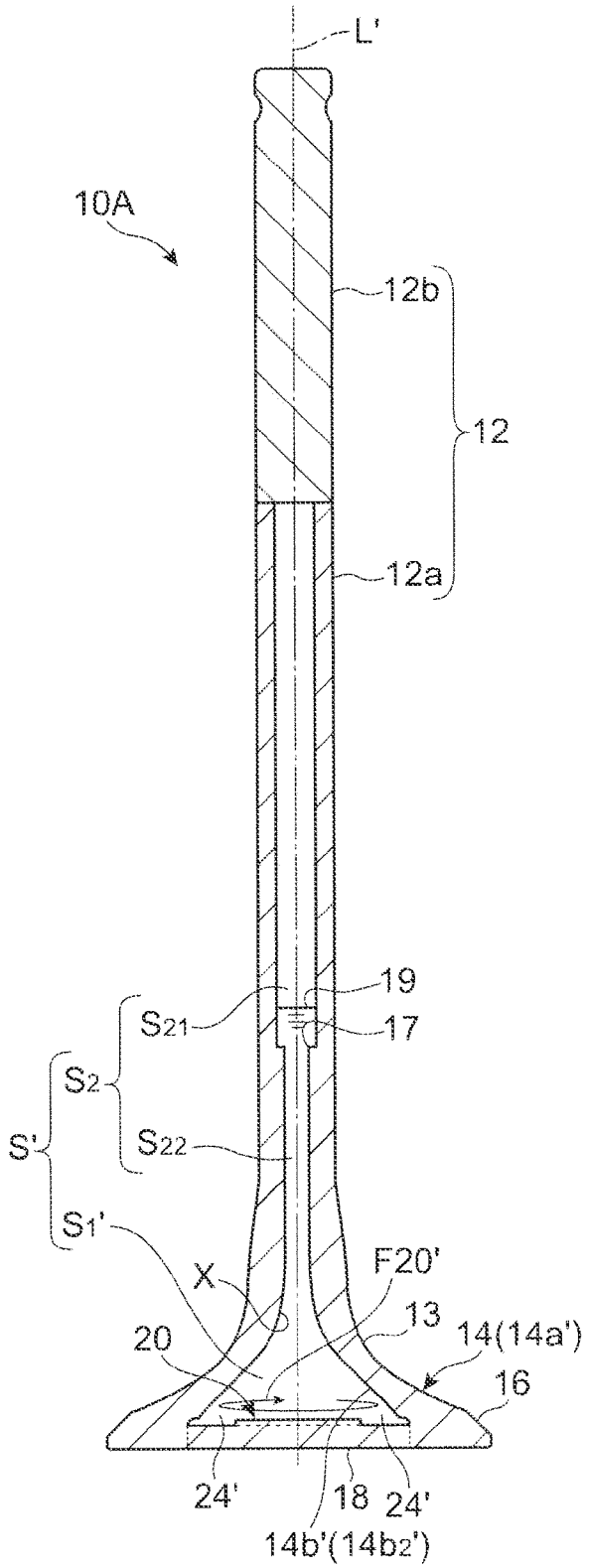
FIG. 7 is a longitudinal cross section of a hollow poppet valve in accordance with a second embodiment of the invention.

FIG. 7 shows a hollow poppet valve in accordance with a second embodiment of the invention.

It is recalled that in the first embodiment the hollow poppet valve 10 is provided with a truncated circular-cone shape valve head cavity S1 in the valve head 14 in communication with a linear diametrically smaller stem cavity S2 perpendicularly to the circular ceiling 14*b*1. In this embodiment, however, the hollow poppet valve 10A is provided with an internal cavity S' which comprises a valve stem cavity S2 in the valve stem 12 in communication with a substantially circular-cone shape valve head cavity S1' in the valve head 14 via a smooth interconnecting region X whose inner diameter gradually varies in the axial direction of the valve as in the prior art poppet valve disclosed in the Patent Documents 1 and 2.

It is seen that a valve head shell 14*a*' has an outer periphery 14*b*2' and a recess 14*b*' which corresponds to a diametrically large valve head cavity S1' in the shape of a truncated circular cone.

In contrast to the first poppet valve 10 provided with swirl-forming protrusions 20 and 30 on the bottom (that is, on the backside of the cap 18) and on the ceiling, respectively, the poppet valve 10A of the second embodiment is provided with swirl-forming protrusions only on the bottom of the valve head cavity S1' (that is, on the backside of the cap 18) to generate a swirl flow F20' of coolant in a lower region of the valve head cavity S1' and around a central axis of the valve L' when the valve is in an upward motion to close the port.

Other structural features of the second embodiment are the same as those of the first embodiment, so that like or same elements are simply referred to by the same symbols in these embodiments and further descriptions of the valve 10A will be omitted.

In this hollow poppet valve 10A as in the poppet valve 10 of the first embodiment, flows of coolant are generated in the valve head cavity S1' along the sloping faces 22 of the swirl-forming protrusions 20 during a reciprocal motion of the valve 10A, particularly when the valve 10A is in an upward motion. These flows gather in the annular passage 24' surrounding the swirl-forming protrusions 20, forming a swirl flow F20' along the periphery of the valve head cavity S1', which stirs a lower layer of the coolant 19 in the valve head cavity S1', thereby activating heat transfer within the internal cavity S' by the coolant 19 and hence enhancing the heat reduction capability of the valve 10A.

Figure 8:
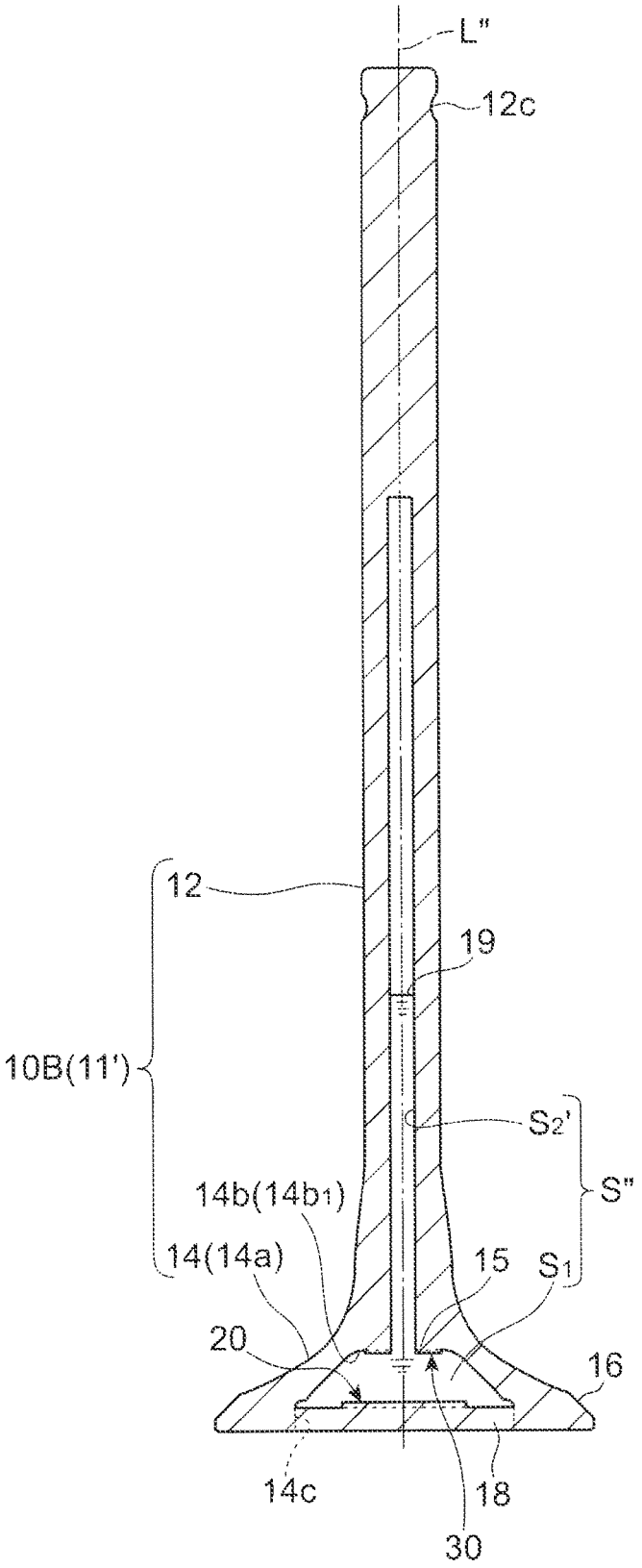
FIG. 8 is a longitudinal cross section of a hollow poppet valve in accordance with a third embodiment of the invention.
Figure 9:
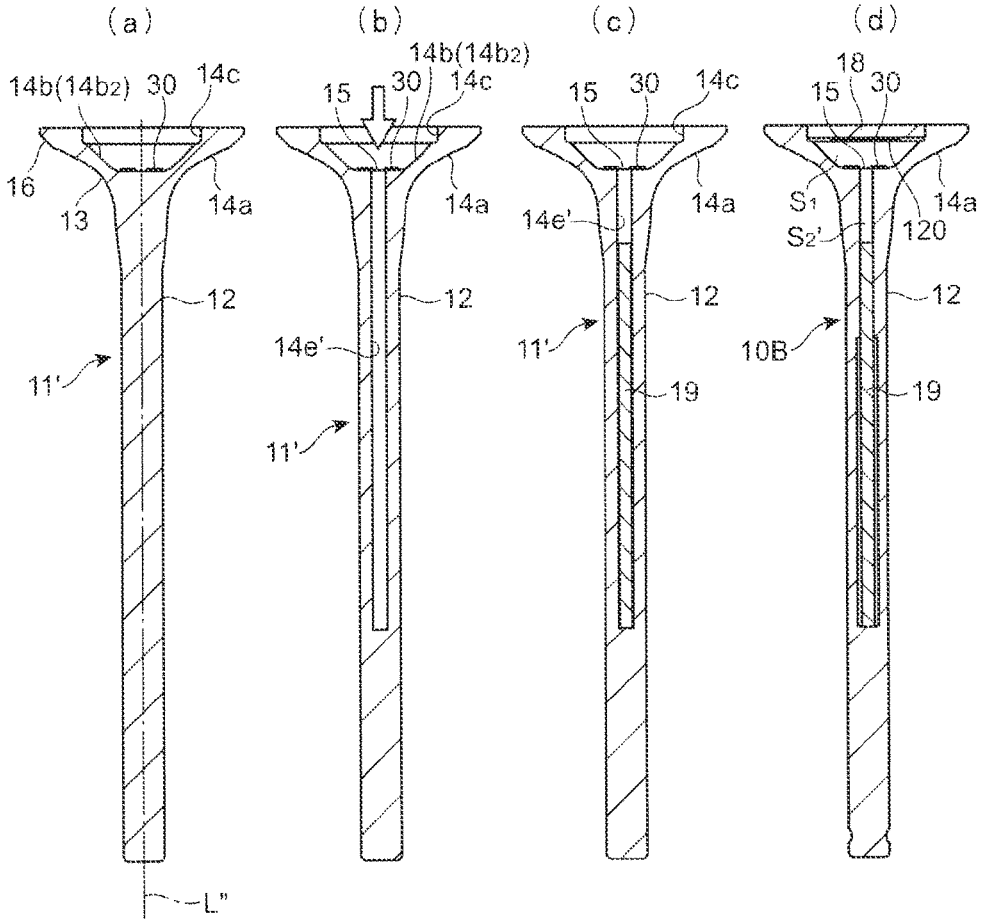
FIG. 9 shows steps of manufacturing the hollow poppet valve. More particularly, FIG. 9(*a*) shows a step of hot-forging a shell of an intermediate valve product.

FIGS. 8 and 9 show a hollow poppet valve 10B in accordance with a third embodiment of the invention.

It is recalled that the stem cavity S2 of the first and second hollow poppet valves 10 and 10A, respectively, has a diametrically larger stem-end side stem cavity S21, a diametrically smaller valve-head side stem cavity S22, and a step 17 in the stem cavity S2. In contrast, the poppet valve 10B has a stem cavity S2' of a constant inner diameter in the valve stem 12.

Other structural features of this embodiment are the same as those of the first embodiment, so that like or same elements are simply referred to by the same symbols in these embodiments and further descriptions of the valve 10B will be omitted.

It should be noted that, unlike in the foregoing poppet valves 10 and 10A in which the coolant 19 is stirred in the stem cavity S2 by the step 17 during a reciprocal motion of the valve, stirring of coolant 19 is not induced in the stem cavity S2 by the step 17 of this poppet valve 10B. However, in this poppet valve 10B, swirl flows F20 and F30 (FIGS. 2 and 3) are generated in the valve head cavity S1 in addition to tumble flows T1 and T2 (FIG. 5) around the central axis L" during reciprocal motions of the valve, as in the case of poppet valve 10. Furthermore, since turbulent flows F4 and F5 and a whirlpool F40 of coolant 19 are generated in the stem cavity S2' (FIG. 5), the entirety of the coolant 19 in the internal cavity S" is vigorously stirred, and the heat reduction capability (the heat conduction ability) of the valve 10B is greatly enhanced.

It is noted that no step is formed in the stem cavity S2' of the valve stem 12 in the process of manufacturing the hollow poppet valve 10B as shown in FIG. 9. Therefore, the process of manufacturing the valve is simplified since a step of drilling a hole 14*e'* for the stem cavity S2' is required only once and welding of a stem end member is not needed.

In the manufacture of the hollow poppet valve 10B, a shell 11' is first formed by hot forging such that the shell 11' comprises a stem 12 integral with a valve head shell 14*a* which has a truncated-circular-cone shape recess 14*b*, as shown in FIG. 9(*a*). At the same time as forming the shell 11', circularly arranged swirl-forming protrusions 30, spaced apart at substantially equal intervals in the circumferential direction, are formed on the bottom 14*b*1 of the recess 14*b*.

Next (in a drilling step), as shown in FIG. 9(*b*), a hole 14*e'* is drilled in the stem 12 and across the bottom 14*b*1 of the recess 14*b* to form a diametrically smaller stem cavity S2'.

In the next coolant charging step as shown in FIG. 9(*c*), a predetermined amount of solidified coolant 19 is put in the hole 14*e'* communicated with the recess 14*b*.

Finally, in a cavity sealing step, a cap 18 formed with swirl-forming protrusions 20 on the backside thereof is welded by resistance welding, for example, under an argon atmosphere, onto the open end of the inner periphery 14*c* of the recess 14*b* to seal inner cavities S" of the valve 10B as shown in FIG. 9(*d*).

Figure 10:
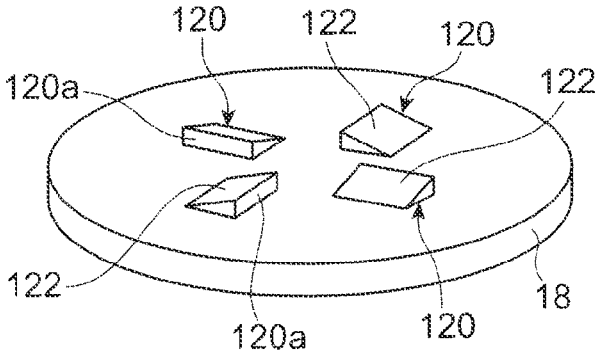
FIG. 10 is a perspective view of another example in which swirl-forming protrusions are provided on the bottom of the valve head cavity (or on the backside of the cap).

FIG. 10 is a perspective view of another example of swirl-forming protrusions provided on the bottom of the valve head cavity (or on the backside of the cap).

In the foregoing three embodiments, the swirl-forming protrusions 20 formed on the backside of the cap 18, serving as the bottoms of the valve head cavities S1 and S1', are formed with swirl vanes with their sloping faces 22 each inclined downward in the circumferential direction from its highest arcuate rear wall 20*a*. FIG. 10 shows four swirl-forming protrusions 120 spaced apart at equal intervals in the circumferential direction, each protrusion formed with a rectangular sloping face 122 which has a triangular transverse cross section and is sloped from its highest rear wall 120*a*.

It is noted that the sloping faces 22, 32, and 122 of the swirl-forming protrusions 20, 120, and 30 which are shown by the above embodiments, respectively, are inclined in the circumferential direction to push forward the coolant 19 along the sloping faces, that is, in the circumferential direction, during a reciprocal axial motion of the valve so as to generate flows of coolant in the circumferential direction. It should be understood, however, that the swirl-forming protrusions are not limited in shape to those (20, 120, and 30) described above, so long as they can induce swirl flows in the coolant during reciprocal motions of the valve.

BRIEF DESCRIPTION OF THE DRAWINGS

2 cylinder head
3*a* valve guide
4 combustion chamber
6 exhaust port
10, 10A, and 10B hollow poppet valves
11, 11' integral shells of valve head and valve stem
12 valve stem
12*a* stem
14 valve head
14*a*, 14*a'* valve head shells
14*b* truncated-circular-cone shape recess
14*b'* circular-cone shape recess
14*b*1 circular ceiling of valve head cavity
14*b*2, 14*b*2' conic inner peripheries of recesses of valve head shells (conic peripheries of valve head cavities)
15 cave shape annular step round one end of valve stem cavity open to the ceiling of valve head cavity
17 step formed in valve stem cavity
18 cap
19 coolant
20, 30, 120 swirl-forming protrusions
22, 32, 122 swirl-forming sloping faces
L, L', L" central axis of valves
S, S', S" inner cavities
S1 valve head cavity
S1' circular cone shape valve-head cavity
P interconnecting region
S2 and S2' linear stem-cavities
S21 stem-end side stem cavity
S22 valve-head side stem cavity F20, F20', F30, and F31 swirl flows
F40 whirlpool generated in valve stem cavity
T1, T2 tumble flows
F4 and F5 turbulent flows
F9 and F10 turbulent flows

The invention claimed is:

1. A hollow poppet valve comprising:
a stem:
a valve head integrally formed at one end of the stem, and
an internal cavity that extends from inside the valve head into the stem, the internal cavity loaded with a coolant together with an inert gas,
wherein the internal cavity has a diametrically large valve head cavity formed in the valve head and a diametrically small linear stem cavity formed in the stem in communication with a central region of the valve head cavity, and
wherein a plurality of swirl-forming protrusions are formed on at least one of a bottom and a ceiling of the valve head cavity, the swirl-forming protrusions being positioned at substantially equal intervals in a circumferential direction of the valve head cavity,
wherein each of the protrusions has a sloping face inclined in the circumferential direction to generate a swirl flow of the coolant in the valve head cavity around a central axis of the valve during a reciprocal motion of the valve in a direction along the central axis, and
wherein the swirl-forming protrusions are provided on the bottom and the ceiling of the valve head cavity and the sloping faces of the protrusions which are provided on the bottom are inclined in the circumferential direction in a vertically reverse direction of the sloping faces of the protrusions which are provided on the ceiling.

2. The hollow poppet valve according to claim 1,
wherein the swirl-forming protrusions are offset from a periphery of the valve head cavity by a predetermined distance so as to provide a circular fluid channel around the protrusions and along the periphery of the valve head cavity, and
wherein the sloping faces of the protrusions are inclined towards the fluid channel.

3. The hollow poppet valve according to claim 2,
wherein the valve head cavity is formed in a shape of a truncated circular cone having a tapered outer periphery substantially parallel to an outer periphery of a valve head shell of the valve head, and
wherein the stem cavity communicates with the ceiling of the valve head cavity in a substantially perpendicular manner,
wherein tumble flows of coolant are formed at least in the valve head cavity around the central axis of the valve during a reciprocal motion of the valve.

4. The hollow poppet valve according to claim 1,
wherein the valve head cavity is formed in a shape of a truncated circular cone having a tapered outer periphery substantially parallel to an outer periphery of a valve head shell of the valve head, and
wherein the stem cavity communicates with the ceiling of the valve head cavity in a substantially perpendicular manner,
wherein tumble flows of coolant are formed at least in the valve head cavity around the central axis of the valve during a reciprocal motion of the valve.

5. The hollow poppet valve according to claim 1,
wherein each of the plurality of protrusions is positioned such that a sloping face of one of the protrusions ends at another one of the protrusions.

6. The hollow poppet valve according to claim 1,
wherein each of the plurality of protrusions has a rectangular sloping face and a triangular transverse cross section.

7. A hollow poppet valve comprising:
a stem:
a valve head integrally formed at one end of the stem, and
an internal cavity that extends from inside the valve head into the stem, the internal cavity loaded with a coolant together with an inert gas,
wherein the internal cavity has a diametrically large valve head cavity formed in the valve head and a diametrically small linear stem cavity formed in the stem in communication with a central region of the valve head cavity,
wherein a plurality of swirl-forming protrusions are formed on at least one of a bottom and a ceiling of the valve head cavity, the swirl-forming protrusions being positioned at substantially equal intervals in a circumferential direction of the valve head cavity,
wherein each of the protrusions has a sloping face inclined in the circumferential direction to generate a swirl flow of the coolant in the valve head cavity around a central axis of the valve during a reciprocal motion of the valve in a direction along the central axis, and
wherein each of the plurality of protrusions is positioned such that a sloping face of one of the protrusions ends at another one of the protrusions.

8. A hollow poppet valve comprising:
a stem:
a valve head integrally formed at one end of the stem, and
an internal cavity that extends from inside the valve head into the stem, the internal cavity loaded with a coolant together with an inert gas,
wherein the internal cavity has a diametrically large valve head cavity formed in the valve head and a diametrically small linear stem cavity formed in the stem in communication with a central region of the valve head cavity,
wherein a plurality of swirl-forming protrusions are formed on at least one of a bottom and a ceiling of the valve head cavity, the swirl-forming protrusions being positioned at substantially equal intervals in a circumferential direction of the valve head cavity,
wherein each of the protrusions has a sloping face inclined in the circumferential direction to generate a swirl flow of the coolant in the valve head cavity around a central axis of the valve during a reciprocal motion of the valve in a direction along the central axis, and
wherein each of the plurality of protrusions has a rectangular sloping face and a triangular transverse cross section.

* * * * *